US011011103B2

(12) United States Patent
Yue et al.

(10) Patent No.: US 11,011,103 B2
(45) Date of Patent: May 18, 2021

(54) PIXEL CIRCUIT AND DISPLAY DEVICE INCLUDING LIGHT EMISSION CONTROL CIRCUIT

(71) Applicant: BOE TECHNOLOGY GROUP CO., LTD., Beijing (CN)

(72) Inventors: Han Yue, Beijing (CN); Ming Yang, Beijing (CN); Can Wang, Beijing (CN); Can Zhang, Beijing (CN); Minghua Xuan, Beijing (CN); Xiaochuan Chen, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/488,921

(22) PCT Filed: Jan. 3, 2019

(86) PCT No.: PCT/CN2019/070177
§ 371 (c)(1),
(2) Date: Aug. 26, 2019

(87) PCT Pub. No.: WO2019/205728
PCT Pub. Date: Oct. 31, 2019

(65) Prior Publication Data

US 2020/0302855 A1 Sep. 24, 2020

(30) Foreign Application Priority Data

Apr. 27, 2018 (CN) ..... 201820624128.9

(51) Int. Cl.
*G09G 3/32* (2016.01)
*G09G 3/3258* (2016.01)

(52) U.S. Cl.
CPC ..... *G09G 3/32* (2013.01); *G09G 3/3258* (2013.01); *G09G 2300/0426* (2013.01); *G09G 2320/0626* (2013.01)

(58) Field of Classification Search
CPC ..... G09G 3/32; G09G 3/3258; G09G 2300/0426; G09G 2320/0626
See application file for complete search history.

(56) References Cited

U.S. PATENT DOCUMENTS 8,325,113 B2 * 12/2012 Kim ..... G09G 3/3233 345/76
8,659,521 B2 * 2/2014 Osame ..... G09G 3/2022 345/82

(Continued)

FOREIGN PATENT DOCUMENTS

CN 101996580 A 3/2011
CN 103646629 A 3/2014

(Continued)

*Primary Examiner* — Kwang-Su Yang
(74) *Attorney, Agent, or Firm* — Muncy, Geissler, Olds and Lowe, P.C.

(57) ABSTRACT

A pixel circuit includes a first driving circuit, a light-emitting element, a second driving circuit, an energy storage circuit and an input circuit. A first end of the first driving circuit is connected to a power source voltage input end. An anode of the light-emitting element is connected to a second end of the first driving circuit. A first end of the second driving circuit is connected to a first level signal input end, a second end thereof is connected to a cathode of the light-emitting element. The energy storage circuit is connected to control ends of the first driving circuit and the second driving circuit, a second level signal input end. The input circuit is connected to a data signal input end, an input control end, the control end of the first driving circuit and the control end of the second driving circuit.

16 Claims, 3 Drawing Sheets

(56) References Cited

U.S. PATENT DOCUMENTS

| | | | | |
|---|---|---|---|---|
| 2008/0197784 | A1* | 8/2008 | Benzarti | G09G 3/3233 315/169.3 |
| 2015/0116191 | A1* | 4/2015 | Qi | G09G 3/3233 345/76 |
| 2018/0330668 | A1 | 11/2018 | Luo et al. | |
| 2019/0251905 | A1 | 8/2019 | Yang et al. | |

FOREIGN PATENT DOCUMENTS

| | | | |
|---|---|---|---|
| CN | 104392689 | A | 3/2015 |
| CN | 106782271 | A | 5/2017 |
| CN | 106935193 | A | 7/2017 |
| CN | 107424570 | A | 12/2017 |
| CN | 208045072 | U | 11/2018 |
| CN | 109003575 | A | 12/2018 |
| JP | 2009-229526 | A | 10/2009 |

* cited by examiner

PIXEL CIRCUIT AND DISPLAY DEVICE INCLUDING LIGHT EMISSION CONTROL CIRCUIT

CROSS-REFERENCE TO RELATED APPLICATION

The present application is the U.S. national phase of PCT Application No. PCT/CN2019/070177 filed on Jan. 3, 2019, which claims a priority of the Chinese patent application No. 201820624128.9 filed on Apr. 27, 2018, which is incorporated herein by reference in its entirety.

TECHNICAL FIELD

The present disclosure relates to the field of display technology, in particular to a pixel circuit and a display device.

BACKGROUND

As a new-generation display technology, micro light-emitting diode (LED) display includes an array of miniaturized LEDs, i.e., the LEDs are thinned and miniaturized to form an array, so that each LED has a volume about 1% of a conventional LED. In this way, it is able to reduce a distance between adjacent pixels from a millimeter level to a micrometer level. In the related art, during the manufacture of the micro LED display, usually a micro LED pixel unit and a pixel driving circuit for driving the pixel unit are both formed on a silicon substrate, so as to acquire a silicon-based micro LED display. However, due to the limitation of the manufacture process, a data range applied by the pixel circuit to the pixel unit is limited to some extent, and thereby a brightness adjustment range of the pixel is limited too.

SUMMARY

In one aspect, the present disclosure provides in some embodiments a pixel circuit, including: a first driving circuit, a first end of which is connected to a power source voltage input end; a light-emitting element, an anode of which is connected to a second end of the first driving circuit; a second driving circuit, a first end of which is connected to a first level signal input end, and a second end of which is connected to a cathode of the light-emitting element; an energy storage circuit connected to a control end of the first driving circuit, a control end of the second driving circuit and a second level signal input end; and an input circuit connected to a data signal input end, an input control end, the control end of the first driving circuit and the control end of the second driving circuit, and configured to control the data signal input end to be electrically connected to, or electrically disconnected from, the control end of the first driving circuit, and control the data signal input end to be electrically connected to, or electrically disconnected from, the control end of the second driving circuit under the control of the input control end.

In a possible embodiment of the present disclosure, the input control end includes a first input control end and a second input control end. The input circuit includes: a first input sub-circuit connected to the data signal input end, the first input control end and the control end of the first driving circuit, and configured to control the data signal input end to be electrically connected to, or electrically disconnected from, the control end of the first driving circuit under the control of the first input control end; and a second input sub-circuit connected to the data signal input end, the second input control end and the control end of the second driving circuit, and configured to control the data signal input end to be electrically connected to, or electrically disconnected from, the control end of the second driving circuit under the control of the second input control end.

In a possible embodiment of the present disclosure, the first input sub-circuit includes a first switching transistor, a gate electrode of which is connected to the first input control end, a first electrode of which is connected to the data signal input end, and a second electrode of which is connected to the control end of the first driving circuit. The second input sub-circuit includes a second switching transistor, a gate electrode of which is connected to the second input control end, a first electrode of which is connected to the data signal input end, and a second electrode of which is connected to the control end of the second driving circuit.

In a possible embodiment of the present disclosure, the data signal input end includes a first data signal input end and a second data signal input end. The input circuit includes: a third input sub-circuit connected to the first data signal input end, the input control end and the control end of the first driving circuit, and configured to control the first data signal input end to be electrically connected to, or electrically disconnected from, the control end of the first driving circuit under the control of the input control end; and a fourth input sub-circuit connected to the second data signal input end, the input control end and the control end of the second driving circuit, and configured to control the second data signal input end to be electrically connected to, or electrically disconnected from, the control end of the second driving circuit under the control of the input control end.

In a possible embodiment of the present disclosure, the third input sub-circuit includes a third switching transistor, a gate electrode of which is connected to the input control end, a first electrode of which is connected to the first data signal input end, and a second electrode of which is connected to the control end of the first driving circuit. The fourth input sub-circuit includes a fourth switching transistor, a gate electrode of which is connected to the input control end, a first electrode of which is connected to the second data signal input end, and a second electrode of which is connected to the control end of the second driving circuit.

In a possible embodiment of the present disclosure, the pixel circuit further includes a light-emission control circuit, and the first end of the second driving circuit is connected to the first level signal input end via the light-emission control circuit. The light-emission control circuit is connected to a light-emission control end, the first end of the second driving circuit and the first level signal input end, and configured to control the first end of the second driving circuit to be electrically connected to, or electrically disconnected from, the first level signal input end under the control of the light-emission control end.

In a possible embodiment of the present disclosure, the light-emission control circuit includes a fifth switching transistor, a gate electrode of which is connected to the light-emission control end, a first electrode of which is connected to the first end of the second driving circuit, and a second electrode of which is connected to the first level signal input end.

In a possible embodiment of the present disclosure, the energy storage sub-circuit includes: a first energy storage sub-circuit, a first end of which is connected to the control end of the first driving circuit, and a second end of which is connected to the second level signal input end; and a second energy storage sub-circuit, a first end of which is connected to the control end of the second driving circuit, and a second end of which is connected to the second level signal input end.

In a possible embodiment of the present disclosure, the first driving circuit includes a first driving transistor, the control end of the first driving circuit includes a gate electrode of the first driving transistor, the first end of the first driving circuit includes a first electrode of the first driving transistor, and the second end of the first driving circuit includes a second electrode of the first driving transistor. The second driving circuit includes a second driving transistor, the control end of the second driving circuit includes a gate electrode of the second driving transistor, the first end of the second driving circuit includes a first electrode of the second driving transistor, and the second end of the second driving circuit includes a second electrode of the second driving transistor.

In a possible embodiment of the present disclosure, the first driving transistor is an N-type metal oxide semiconductor field-effect transistor (NMOSFET), and the second driving transistor is a P-type metal oxide semiconductor field-effect transistor (PMOSFET).

In another aspect, the present disclosure provides in some embodiments a display device including the above-mentioned pixel circuit.

BRIEF DESCRIPTION OF THE DRAWINGS

The following drawings are provided to facilitate the understanding of the present disclosure, and constitute a portion of the description. These drawings and the following embodiments are for illustrative purposes only, but shall not be construed as limiting the present disclosure. In these drawings.

DETAILED DESCRIPTION

The present disclosure will be described hereinafter in conjunction with the drawings and embodiments.

Figure 1:
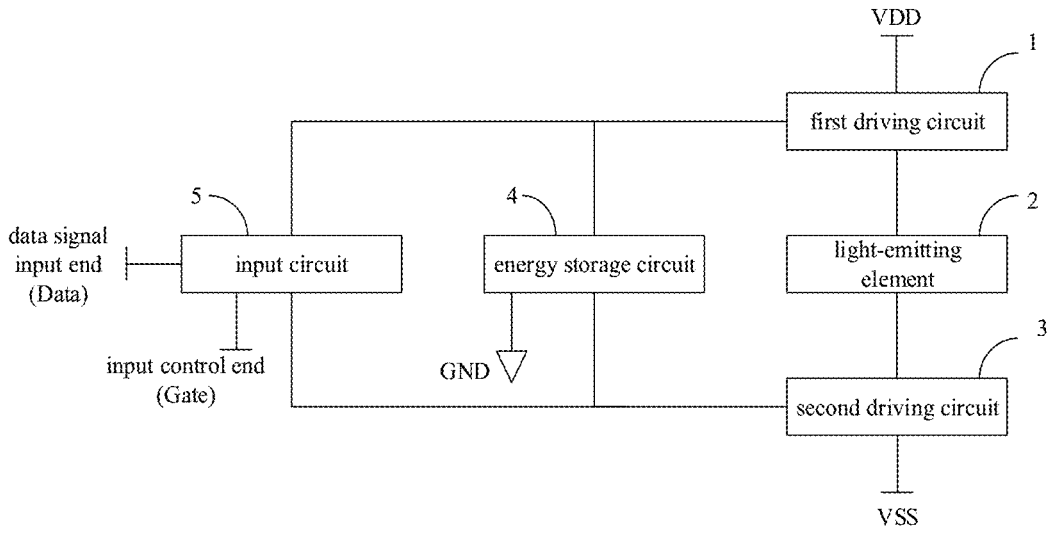
FIG. 1 is a schematic view showing a pixel circuit according to one embodiment of the present disclosure.

The present disclosure provides in some embodiments a pixel circuit which, as shown in FIG. 1, includes a first driving circuit 1, a light-emitting element 2, a second driving circuit 3, an energy storage circuit 4 and an input circuit 5 arranged on a silicon substrate. A first end of the first driving circuit 1 is connected to a power source voltage input end VDD, and an anode of the light-emitting element 2 is connected to a second end of the first driving circuit 1. A first end of the second driving circuit 3 is connected to a first level signal input end VSS, and a second end of the second driving circuit 3 is connected to a cathode of the light-emitting element 2. The energy storage circuit 4 is connected to a control end of the first driving circuit 1, a control end of the second driving circuit 3, and a second level signal input end. The input circuit 5 is connected to a data signal input end Data, an input control end Gate, the control end of the first driving circuit 1, and the control end of the second driving circuit 3, and configured to control the data signal input end Data to be electrically connected to, or electrically disconnected from, the control end of the first driving circuit 1, and control the data signal input end Data to be electrically connected to, or electrically disconnected from, the control end of the second driving circuit 3 under the control of the input control end Gate. It should be appreciated that, the light-emitting element 2 may be, but not limited to, a micro LED or an OLED.

A working procedure of the pixel circuit within one driving period will be described as follows.

At a data write-in stage, the input circuit 5 may control the data signal input end Data to be electrically connected to the control end of the first driving circuit 1 under the control of the input control end Gate, so as to write a first data signal inputted by the data signal input end Data into the control end of the first driving circuit 1, and store the first data signal in the energy storage circuit 4. In addition, the input circuit 5 may also control the data signal input end to be electrically connected to the control end of the second driving circuit 3 under the control of the input control end, so as to write a second data signal inputted by the data signal input end into the control end of the second driving circuit 3, and store the second data signal in the energy storage circuit 4.

At a light-emitting stage, the first driving circuit 1 and the second driving circuit 3 are controlled to be in an on state through the first data signal and the second data signal respectively, so that each of the first driving circuit 1 and the second driving circuit 3 forms a source follower circuit. Hence, when the light-emitting element 2 emits light, a voltage applied to the anode of the light-emitting element 2 may change along with the first data signal written into the control end of the first driving circuit 1, and a voltage applied to the cathode of the light-emitting element 2 may change along with the second data signal written into the control end of the second driving circuit 3. In this way, through adjusting the first data signal and the second data signal, it is able to adjust a brightness value of the light-emitting element, thereby to control the light-emitting element 2 to emit light.

Based on the structure and the working procedure of the pixel circuit mentioned hereinabove, the anode and the cathode of the light-emitting element 2 may be connected to the first driving circuit 1 and the second driving circuit 3 respectively. At the data write-in stage, the first data signal and the second data signal may be written by the input circuit 5 into the control end of the first driving circuit 1 and the control end of the second driving circuit 3 respectively, and the first data signal and the second data signal may be stored in the energy storage circuit 4. At the light-emitting stage, the first driving circuit 1 and the second driving circuit 3 may be in the on state under the control of the first data signal and the second data signal respectively, so as to drive the light-emitting element 2 to emit light.

Hence, for the pixel circuit in the embodiments of the present disclosure, the anode and the cathode of the light-emitting element 2 are connected to the first driving circuit 1 and the second driving circuit 3 respectively, so the first driving circuit 1 and the second driving circuit 3 may each form a source follower circuit. When the light-emitting element 2 emits light, the voltage applied to the anode of the light-emitting element 2 may change along with the first data signal written into the control end of the first driving circuit 1, and the voltage applied to the cathode of the light-emitting element 2 may change along with the second data signal written into the control end of the second driving circuit 3. The voltage applied to each of the anode and the cathode of the light-emitting element 2 may be adjusted within a certain range, so the brightness value of the light-emitting element 2 may be adjusted within a larger range. As a result, it is able to solve the problem of a conventional micro LED display device where a brightness adjustment range of the pixel is relatively narrow, thereby to meet the requirements of high contrast and high brightness simultaneously, and enlarge an application range.

Figure 3:
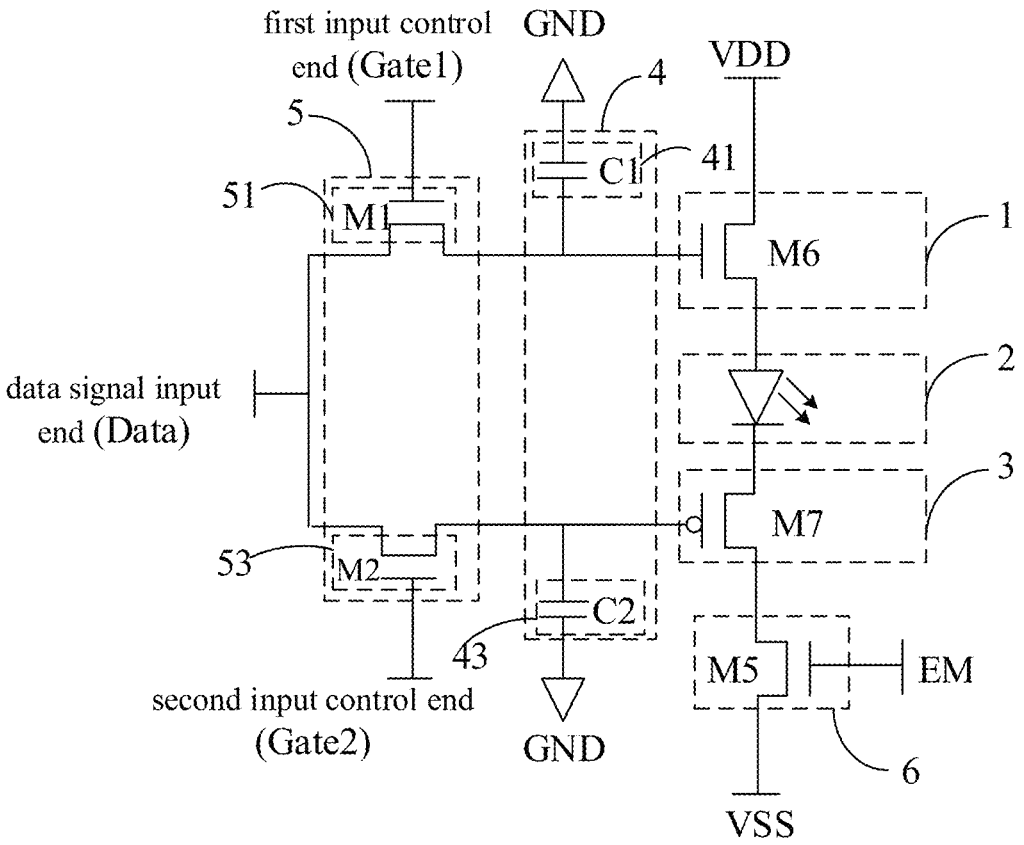
FIG. 3 is yet another schematic view showing the pixel circuit according to one embodiment of the present disclosure.
Figure 5:
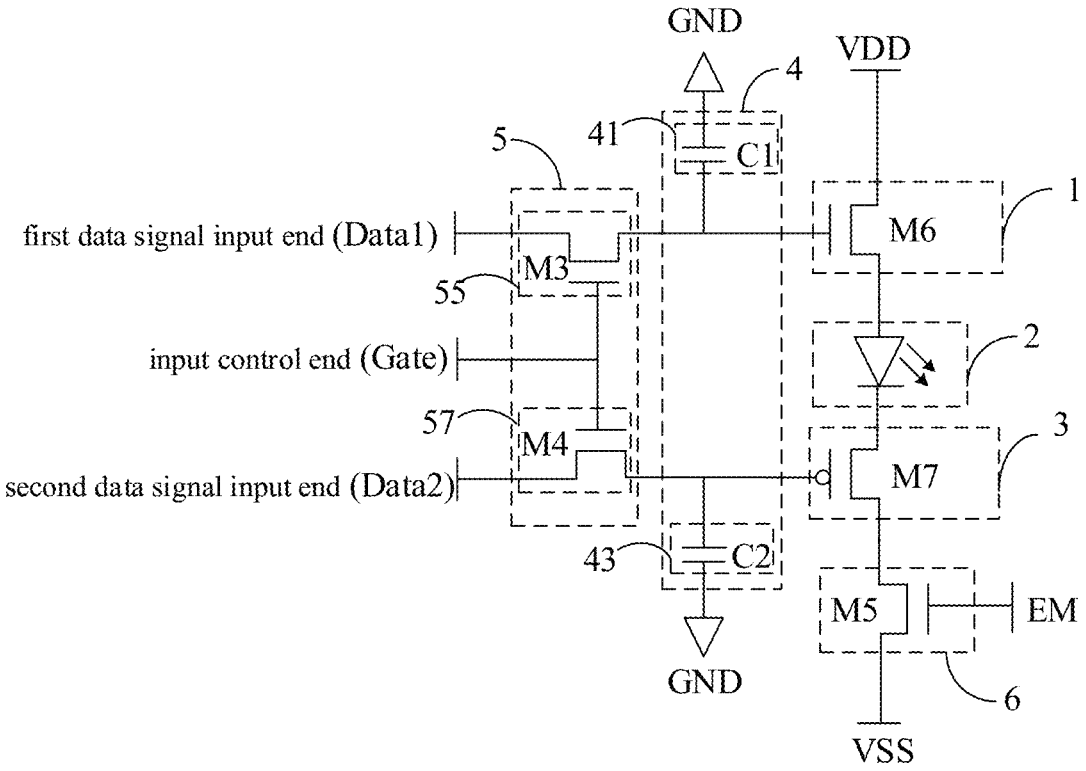
FIG. 5 is still yet another schematic view showing the pixel circuit according to one embodiment of the present disclosure.

Further, as shown in FIGS. 3 and 5, each of the first driving circuit 1 and the second driving circuit 3 may be of various structures. For example, the first driving circuit 1 may include a first driving transistor M6, the control end of the first driving circuit 1 may include a gate electrode of the first driving transistor M6, the first end of the first driving circuit 1 may include a first electrode of the first driving transistor M6, and the second end of the first driving circuit 1 may include a second electrode of the first driving transistor M6. The second driving circuit 3 may include a second driving transistor M7, the control end of the second driving circuit 3 may include a gate electrode of the second driving transistor M7, the first end of the second driving circuit 3 may include a first electrode of the second driving transistor M7, and the second end of the second driving circuit 3 may include a second electrode of the second driving transistor M7.

To be specific, when the first driving circuit 1 includes the first driving transistor M6 and the second driving circuit 3 includes the second driving transistor M7, a voltage applied to the anode of the light-emitting element 2 may be $GATE_{M6}-VTH_{M6}$, and a voltage applied to the cathode of the light-emitting element 2 may be $GATE_{M7}-VTH_{M7}$, where $GATE_{M6}$ represents a voltage applied to the control end of the first driving circuit 1, i.e., a gate voltage of the first driving circuit M6, $VTH_{M6}$ represents a threshold voltage of the first driving transistor M6, $GATE_{M7}$ represents a voltage applied to the control end of the second driving circuit 3, i.e., a gate voltage of the second driving circuit M7, and $VTH_{M7}$ represents a threshold voltage of the second driving transistor M7. Hence, the voltage applied to each of the anode and the cathode of the light-emitting element 2 may be adjusted within a certain range, so it is able to enlarge a brightness adjustment range of the light-emitting element 2.

More specifically, when the cathode of the light-emitting element 2 is directly connected to the first level signal input end VSS and a range of the data signal applied to the pixel circuit is AU, a voltage difference across two ends of the light-emitting element 2 may also be AU, due to the limitation of the manufacture process. According to the pixel circuit in the embodiments of the present disclosure, the cathode of the light-emitting element 2 may be connected to the second driving transistor, and a manufacture process of the second driving transistor may be the same as that of the first driving transistor, so the voltage applied to the cathode of the light-emitting element 2 may be adjusted within a same range as that applied to the anode of the light-emitting element 2. Hence, the voltage difference across the two ends of the light-emitting element 2 may be 2*AU, i.e., the brightness adjustment range of the light-emitting element 2 may be enlarged correspondingly.

Various structures and connection modes may be provided for the input circuit 5, and two of them will be described hereinafter.

Figure 4:
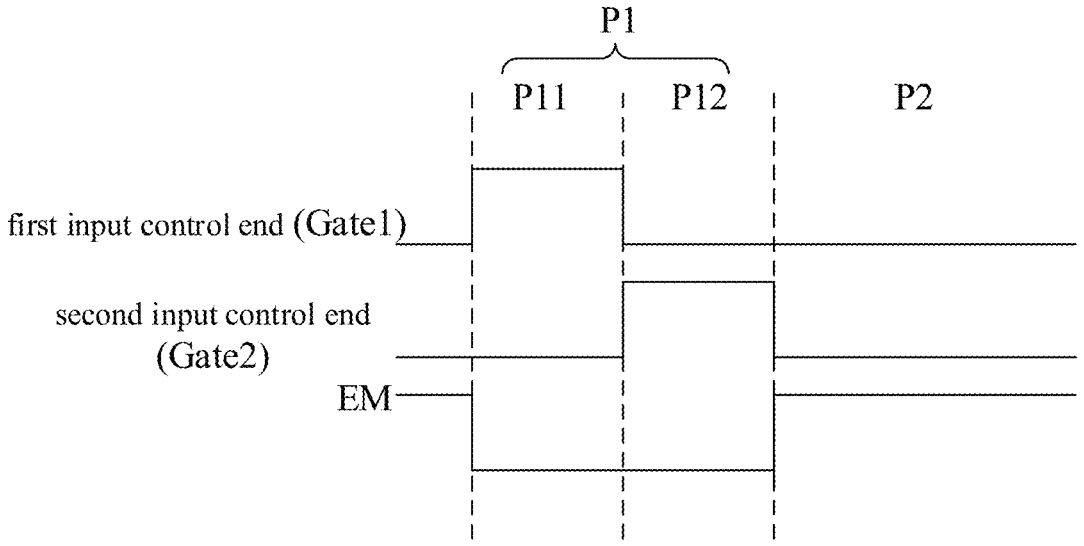
FIG. 4 is a time sequence diagram of the pixel circuit according to one embodiment of the present disclosure.

In a first mode, as shown in FIGS. 3 and 4, the input control end Gate may include a first input control end Gate1 and a second input control end Gate2. The input circuit 5 may include: a first input sub-circuit 51 connected to the data signal input end Data, the first input control end Gate1 and the control end of the first driving circuit 1, and configured to control the data signal input end Data to be electrically connected to, or electrically disconnected from, the control end of the first driving circuit 1 under the control of the first input control end Gate1; and a second input sub-circuit 53 connected to the data signal input end Data, the second input control end Gate2 and the control end of the second driving circuit 3, and configured to control the data signal input end Data to be electrically connected to, or electrically disconnected from, the control end of the second driving circuit 3 under the control of the second input control end Gate2.

To be specific, a working procedure of the input circuit 5 will be described as follows.

At a first data write-in stage P11 of the data write-in stage P1, the data signal input end Data may input a first data signal, and the first input sub-circuit may control the data signal input end Data to be electrically connected to the control end of the first driving circuit 1 under the control of the first input control end Gate1, so as to write the first data signal into the control end of the first driving circuit 1 and store the first data signal in the energy circuit 4.

At a second data write-in stage P12 of the data write-in stage P1, the data signal input end Data may input a second data signal, and the second input sub-circuit may control the data signal input end Data to be electrically connected to the control end of the second driving circuit 3 under the control of the second input control end Gate2, so as to write the second data signal into the control end of the second driving circuit 3 and store the second data signal in the energy circuit 4.

At the light-emitting stage P2, the first input sub-circuit may control the data signal input end Data to be electrically disconnected from the control end of the first driving circuit 1 under the control of the first input control end Gate1, and the second input sub-circuit may control the data signal input end Data to be electrically disconnected from the control end of the second driving circuit 3 under the control of the second input control end Gate2.

In the first mode, the data signal input end Data may be reused, so that the data signal input end Data may input the first data signal at the first data write-in stage P11 and input the second data signal at the second data write-in stage P12. In addition, the first input sub-circuit and the second input sub-circuit may be controlled by the first input control end Gate1 and the second input control end Gate2 respectively. Hence, at the first data write-in stage P11, the first input sub-circuit may control the data signal input end Data to be electrically connected to the control end of the first driving circuit 1 under the control of the first input control end Gate1, and at the second data write-in stage P12, the first input sub-circuit may control the data input signal end Data to be electrically disconnected from the control end of the first driving circuit 1 under the control of the first input control end Gate1. At the second data write-in stage P12, the second input circuit may control the data signal input end Data to be electrically connected to the control end of the second driving circuit 3 under the control of the second input control end Gate2, and at the first data write-in stage P11, the second input sub-circuit may control the data signal input end Data to be electrically disconnected from the control end of the second driving circuit 3 under the control of the second input control end Gate2.

Further, in the first mode, the first input sub-circuit 51 may include a first switching transistor M1, a gate electrode of which is connected to the first input control end Gate1, a first electrode of which is connected to the data signal input end Data, and a second electrode of which is connected to the control end of the first driving circuit 1. The second input sub-circuit 53 may include a second switching transistor M2, a gate electrode of which is connected to the second input control end Gate2, a first electrode of which is connected to the data signal input end Data, and a second electrode of which is connected to the control end of the second driving circuit 3.

Figure 6:
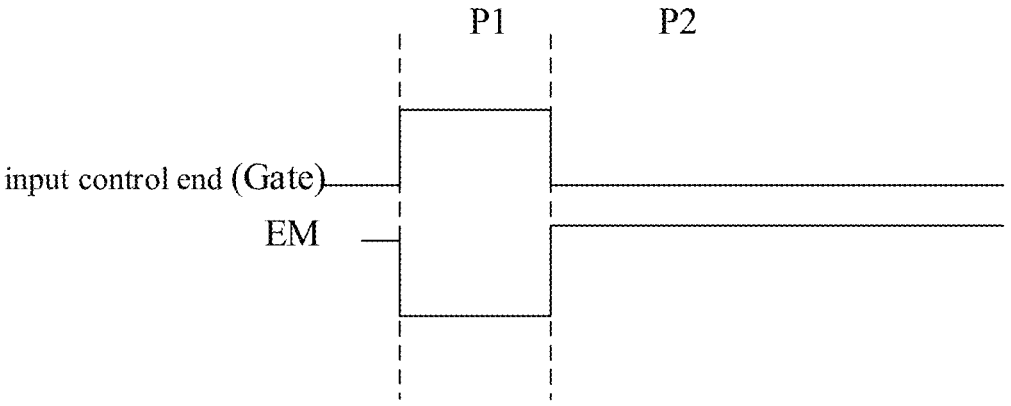
FIG. 6 is another time sequence diagram of the pixel circuit according to one embodiment of the present disclosure.

In a second mode, as shown in FIGS. 5 and 6, the data signal input end Data may include a first data signal input end Data1 and a second data signal input end Data2. The input circuit 5 may include: a third input sub-circuit 55 connected to the first data signal input end Data1, the input control end Gate and the control end of the first driving circuit 1, and configured to control the first data signal input end Data1 to be electrically connected to, or electrically disconnected from, the control end of the first driving circuit 1 under the control of the input control end; and a fourth input sub-circuit 57 connected to the second data signal input end Data2, the input control end Gate and the control end of the second driving circuit 3, and configured to control the second data signal input end Data2 to be electrically connected to, or electrically disconnected from, the control end of the second driving circuit 3 under the control of the input control end.

To be specific, a working procedure of the input circuit 5 will be described as follows.

At the data write-in stage P1, the first data signal input end Data1 may input the first data signal, and the second data signal input end Data2 may input the second data signal. The third input sub-circuit may control the first data signal input end Data1 to be electrically connected to the control end of the first driving circuit 1 under the control of the input control end Gate, so as to write the first data signal into the control end of the first driving circuit 1 and store the first data signal in the energy storage circuit 4. The fourth input sub-circuit may control the second data signal input end Data2 to be electrically connected to the control end of the second driving circuit 3, so as to write the second data signal into the control end of the second driving circuit 3 and store the second data signal in the energy storage circuit 4.

At the light-emitting stage P2, under the control of the input control end Gate, the third input sub-circuit may control the first data signal input end Data1 to be electrically disconnected from the control end of the first driving circuit 1, and the fourth input sub-circuit may control the second data signal input end Data2 to be electrically disconnected from the control end of the second driving circuit 3.

In the second mode, the first data signal input end Data1 and the second data signal input end Data2 may be provided, the third input sub-circuit may be connected to the first data signal input end Data1, and the fourth input sub-circuit may be connected to the second data signal input end Data2. In addition, one input control end Gate may be provided, and the third input sub-circuit and the fourth input sub-circuit may be controlled through the input control end Gate simultaneously. At the data write-in stage P1, the third input sub-circuit may control the first data signal input end Data1 to be electrically connected to the control end of the first driving circuit 1, and the fourth input sub-circuit may control the second data signal input end Data2 to be electrically connected to the control end of the second driving circuit 3. At the light-emitting stage P2, the third input sub-circuit may control the first data signal input end Data1 to be electrically disconnected from the control end of the first driving circuit 1, and the fourth input sub-circuit may control the second data signal input end Data2 to be electrically disconnected from the control end of the second driving circuit 3.

Further, in the second mode, the third input sub-circuit 55 may include a third switching transistor M3, a gate electrode of which is connected to the input control end Gate, a first electrode of which is connected to the first data signal input end Data1, and a second electrode of which is connected to the control end of the first driving circuit 1. The fourth input sub-circuit 57 may include a fourth switching transistor M4, a gate electrode of which is connected to the input control end Gate, a first electrode of which is connected to the second data signal input end Data2, and a second electrode of which is connected to the control end of the second driving circuit 3.

Figure 2:
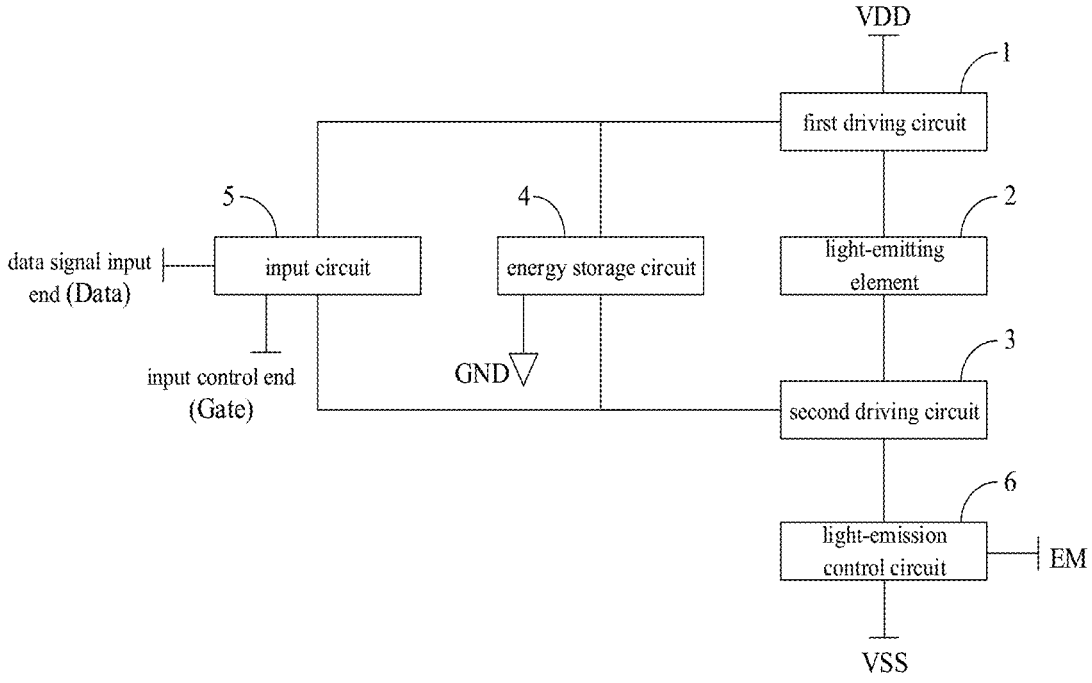
FIG. 2 is another schematic view showing the pixel circuit according to one embodiment of the present disclosure.

As shown in FIG. 2, the pixel circuit may further include a light-emission control circuit 6, and the first end of the second driving circuit 3 may be connected to the first level signal input end VSS via the light-emission control circuit 6. The light-emission control circuit 6 may be connected to a light-emission control end EM, the first end of the second driving circuit 3 and the first level signal input end VSS, and configured to control the first end of the second driving circuit 3 to be electrically connected to, or electrically disconnected from, the first level signal input end VSS under the control of the light-emission control end EM.

To be specific, as shown in FIGS. 4 and 6, a working procedure of the light-emission control circuit 6 will be described as follows.

At the data write-in stage P1, the light-emission control circuit 6 may control the first end of the second driving circuit 3 to be electrically disconnected from the first level signal input end VSS under the control of the light-emission control end EM, so as to enable the light-emitting element 2 not to emit light.

At the light-emitting stage P2, the light-emission control circuit 6 may control the first end of the second driving circuit 3 to be electrically connected to the first level signal input end VSS under the control of the light-emission control end EM, the first driving circuit 1 may be in the on state under the effect of the first data signal, and the second driving circuit 3 may be in the on state under the effect of the second data signal, so as to enable the light-emitting element 2 to emit light.

When the pixel circuit includes the light-emission control circuit 6, it is able to control, through the light-emission control circuit 6, the light-emitting element 2 to merely emit light at the light-emitting stage P2 and not emit light at the other stages. In this way, it is able to ensure a display effect in a better manner.

Further, as shown in FIGS. 3 and 5, the light-emission control circuit 6 may include a fifth switching transistor M5, a gate electrode of which is connected to the light-emission control end EM, a first electrode of which is connected to the first end of the second driving circuit 3, and a second electrode of which is connected to the first level signal input end VSS.

Further, the energy storage sub-circuit 4 may include: a first energy storage sub-circuit 41, a first end of which is connected to the control end of the first driving circuit 1, and a second end of which is connected to the second level signal input end; and a second energy storage sub-circuit 43, a first end of which is connected to the control end of the second driving circuit 3, and a second end of which is connected to the second level signal input end.

To be specific, as shown in FIGS. 3 and 5, the first energy storage sub-circuit may be a first capacitor C1, and the second energy storage sub-circuit may be a second capacitor C2. The first capacitor C1 may be arranged between the control end of the first driving circuit 1 and the second level signal input end. When the first data signal is written into the control end of the first driving circuit 1, the first data signal may be stored in the first capacitor C1, so as to maintain a potential at the control end of the first driving circuit 1 as a first data voltage corresponding to the first data signal. Similarly, the second capacitor C2 may be arranged between the control end of the second driving circuit 3 and the second level signal input end. When the second data signal is written into the control end of the second driving circuit 3, the second data signal may be stored in the second capacitor C2, so as to maintain a potential at the control end of the second driving circuit 3 as a second data voltage corresponding to the second data signal.

It should be appreciated that, the pixel circuit has been described hereinabove on the basis of the above specific circuit structures. In some other embodiments of the present disclosure, the energy storage circuit 4, the input circuit 5 and the light-emission control circuit 6 may each be of any other structures, which will not be particularly defined herein. In addition, the first driving transistor M6, the second driving transistor M7 and the switching transistors may each of a thin film transistor (TFT), a field-effect transistor (FET) or any other element having a same characteristic. In the embodiments of the present disclosure, for the first driving transistor M6, the second driving transistor M7 and the switching transistors, in order to differentiate two electrodes other than a gate electrode from each other, one of the two electrodes may be called as first electrode and the other may be called as second electrode. In actual use, the first electrode may be a drain electrode while the second electrode may be a source electrode, or the first electrode may be a source electrode while the second electrode may be a drain electrode.

The above description has been given when the first driving transistor M6 is an NMOSFET, the second driving transistor M7 is a PMOSFET, the switching transistors are NMOSFETs, the first electrode is a drain electrode and the second electrode is a source electrode. It should be appreciated that, when the first driving transistor M6 is an NMOSFET and the second driving transistor M7 is a PMOSFET, a positive voltage may be applied to the anode of the light-emitting element 2 and a negative voltage may be applied to the cathode of the light-emitting element 2, so as to enable the light-emitting element 2 to achieve a normal display function in a better manner.

In addition, each switching transistor may also be a PMOSFET or a complementary MOSFET (i.e., N/PMOSFET), which also falls within the scope of the present disclosure. The first level signal input end VSS and the second level signal input end may each be a low level signal input end connected to a negative end of a power source. Alternatively, the first level signal input end VSS may be connected to the negative end of the power source, and the second level signal input end may be connected to a ground end GND.

The present disclosure further provides in some embodiments a display device including the above-mentioned pixel circuit.

As mentioned above, according to the pixel circuit in the embodiments of the present disclosure, the anode and the cathode of the light-emitting element 2 may be connected to the first driving circuit 1 and the second driving circuit 3 respectively, so the first driving circuit 1 and the second driving circuit 3 may each form a source follower circuit. The voltage applied to each of the anode and the cathode of the light-emitting element 2 may be adjusted within a certain range, so the brightness value of the light-emitting element 2 may be adjusted within a larger range. As a result, it is able to solve the problem of a conventional micro LED display device where a brightness adjustment range of the pixel is relatively narrow, thereby to meet the requirements of high contrast and high brightness simultaneously, and enlarge an application range. When the display device includes the above-mentioned pixel circuit, it is able to achieve a same beneficial effect, which will thus not be particularly defined herein.

In addition, the pixel circuit in the embodiments of the present disclosure has a small amount of elements and occupies a small area, and when the display device includes the pixel circuit, it may include a large amount of pixel sub-circuitries, so as to improve the display effect.

It should be appreciated that, the display device may include a micro LED display device or an OLED display device.

The features, structures, materials or characteristics mentioned above may be combined in an appropriate manner in any embodiment or embodiments.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A pixel circuit, comprising:

a first driving circuit, a first end of the first driving circuit is connected to a power source voltage input end;

a light-emitting element, an anode of the light-emitting element is connected to a second end of the first driving circuit;

a second driving circuit, a first end of the second driving circuit is connected to a first level signal input end, and a second end of the second driving circuit is connected to a cathode of the light-emitting element;

an energy storage circuit connected to a control end of the first driving circuit, a control end of the second driving circuit and a second level signal input end; and an input circuit connected to a data signal input end, an input control end, the control end of the first driving circuit and the control end of the second driving circuit, and configured to control the data signal input end to be electrically connected to, or electrically disconnected from, the control end of the first driving circuit, and control the data signal input end to be electrically connected to, or electrically disconnected from, the control end of the second driving circuit under the control of the input control end, wherein the pixel circuit further comprises a light-emission control circuit, the first end of the second driving circuit is connected to the first level signal input end via the light-emission control circuit, the light-emission control circuit is connected to a light-emission control end, the first end of the second driving circuit and the first level signal input end, and configured to control the first end of the second driving circuit to be electrically connected to, or electrically disconnected from, the first level signal input end under the control of the light-emission control end.

2. The pixel circuit according to claim 1, wherein the input control end comprises a first input control end and a second input control end, and wherein the input circuit comprises:

a first input sub-circuit connected to the data signal input end, the first input control end and the control end of the first driving circuit, and configured to control the data signal input end to be electrically connected to, or electrically disconnected from, the control end of the first driving circuit under the control of the first input control end; and a second input sub-circuit connected to the data signal input end, the second input control end and the control end of the second driving circuit, and configured to control the data signal input end to be electrically connected to, or electrically disconnected from, the control end of the second driving circuit under the control of the second input control end.

3. The pixel circuit according to claim 2, wherein the first input sub-circuit comprises a first switching transistor, a gate electrode of the first switching transistor is connected to the first input control end, a first electrode of the first switching transistor is connected to the data signal input end, and a second electrode of the first switching transistor is connected to the control end of the first driving circuit, and wherein the second input sub-circuit comprises a second switching transistor, a gate electrode of the second switching transistor is connected to the second input control end, a first electrode of the second switching transistor is connected to the data signal input end, and a second electrode of the second switching transistor is connected to the control end of the second driving circuit.

4. The pixel circuit according to claim 3, wherein the first driving circuit comprises a first driving transistor, the control end of the first driving circuit comprises a gate electrode of the first driving transistor, the first end of the first driving circuit comprises a first electrode of the first driving transistor, and the second end of the first driving circuit comprises a second electrode of the first driving transistor, and wherein the second driving circuit comprises a second driving transistor, the control end of the second driving circuit comprises a gate electrode of the second driving transistor, the first end of the second driving circuit comprises a first electrode of the second driving transistor, and the second end of the second driving circuit comprises a second electrode of the second driving transistor.

5. The pixel circuit according to claim 3, wherein the energy storage sub-circuit comprises:

a first energy storage sub-circuit, a first end of the first energy storage sub-circuit being connected to the control end of the first driving circuit, and a second end of the first energy storage sub-circuit is connected to the second level signal input end; and a second energy storage sub-circuit, a first end of the second energy storage sub-circuit being connected to the control end of the second driving circuit, and a second end of the second energy storage sub-circuit is connected to the second level signal input end.

6. The pixel circuit according to claim 2, wherein the first driving circuit comprises a first driving transistor, the control end of the first driving circuit comprises a gate electrode of the first driving transistor, the first end of the first driving circuit comprises a first electrode of the first driving transistor, and the second end of the first driving circuit comprises a second electrode of the first driving transistor, and wherein the second driving circuit comprises a second driving transistor, the control end of the second driving circuit comprises a gate electrode of the second driving transistor, the first end of the second driving circuit comprises a first electrode of the second driving transistor, and the second end of the second driving circuit comprises a second electrode of the second driving transistor.

7. The pixel circuit according to claim 2, wherein the energy storage sub-circuit comprises:

a first energy storage sub-circuit, a first end of the first energy storage sub-circuit being connected to the control end of the first driving circuit, and a second end of the first energy storage sub-circuit is connected to the second level signal input end; and a second energy storage sub-circuit, a first end of the second energy storage sub-circuit being connected to the control end of the second driving circuit, and a second end of the second energy storage sub-circuit is connected to the second level signal input end.

8. The pixel circuit according to claim 1, wherein the data signal input end comprises a first data signal input end and a second data signal input end, and wherein the input circuit comprises:

a third input sub-circuit connected to the first data signal input end, the input control end and the control end of the first driving circuit, and configured to control the first data signal input end to be electrically connected to, or electrically disconnected from, the control end of the first driving circuit under the control of the input control end; and a fourth input sub-circuit connected to the second data signal input end, the input control end and the control end of the second driving circuit, and configured to control the second data signal input end to be electrically connected to, or electrically disconnected from, the control end of the second driving circuit under the control of the input control end.

9. The pixel circuit according to claim 8, wherein the third input sub-circuit comprises a third switching transistor, a gate electrode of the third switching transistor is connected to the input control end, a first electrode of the third switching transistor is connected to the first data signal input end, and a second electrode of the third switching transistor is connected to the control end of the first driving circuit, and wherein the fourth input sub-circuit comprises a fourth switching transistor, a gate electrode of the fourth switching transistor is connected to the input control end, a first electrode of the fourth switching transistor is connected to the second data signal input end, and a second electrode of the fourth switching transistor is connected to the control end of the second driving circuit.

10. The pixel circuit according to claim 8, wherein the first driving circuit comprises a first driving transistor, the control end of the first driving circuit comprises a gate electrode of the first driving transistor, the first end of the first driving circuit comprises a first electrode of the first driving transistor, and the second end of the first driving circuit comprises a second electrode of the first driving transistor, and wherein the second driving circuit comprises a second driving transistor, the control end of the second driving circuit comprises a gate electrode of the second driving transistor, the first end of the second driving circuit comprises a first electrode of the second driving transistor, and the second end of the second driving circuit comprises a second electrode of the second driving transistor.

11. The pixel circuit according to claim 8, wherein the energy storage sub-circuit comprises:

a first energy storage sub-circuit, a first end of the first energy storage sub-circuit being connected to the control end of the first driving circuit, and a second end of the first energy storage sub-circuit is connected to the second level signal input end; and a second energy storage sub-circuit, a first end of the second energy storage sub-circuit being connected to the control end of the second driving circuit, and a second end of the second energy storage sub-circuit is connected to the second level signal input end.

12. The pixel circuit according to claim 1, wherein the first driving circuit comprises a first driving transistor, the control end of the first driving circuit comprises a gate electrode of the first driving transistor, the first end of the first driving circuit comprises a first electrode of the first driving transistor, and the second end of the first driving circuit comprises a second electrode of the first driving transistor, and wherein the second driving circuit comprises a second driving transistor, the control end of the second driving circuit comprises a gate electrode of the second driving transistor, the first end of the second driving circuit comprises a first electrode of the second driving transistor, and the second end of the second driving circuit comprises a second electrode of the second driving transistor.

13. The pixel circuit according to claim 1, wherein the light-emission control circuit comprises a fifth switching transistor, a gate electrode of the fifth switching transistor is connected to the light-emission control end, a first electrode of the fifth switching transistor is connected to the first end of the second driving circuit, and a second electrode of the fifth switching transistor is connected to the first level signal input end.

14. The pixel circuit according to claim 1, wherein the energy storage sub-circuit comprises:

a first energy storage sub-circuit, a first end of the first energy storage sub-circuit being connected to the control end of the first driving circuit, and a second end of the first energy storage sub-circuit is connected to the second level signal input end; and a second energy storage sub-circuit, a first end of the second energy storage sub-circuit being connected to the control end of the second driving circuit, and a second end of the second energy storage sub-circuit is connected to the second level signal input end.

15. The pixel circuit according to claim 14, wherein: the first energy storage sub-circuit comprises a first capacitor, and the second energy storage sub-circuit comprises a second capacitor;

a first end of the first capacitor is connected to the control end of the first driving circuit, and a second end of the first capacitor is connected to the second level signal input end; and a first end of the second capacitor is connected to the control end of the second driving circuit, and a second end of the second capacitor is connected to the second level signal input end.

16. A display device, comprising the pixel circuit according to claim 1.

* * * * *